US005720542A

United States Patent [19]

Birge, Jr. et al.

[11] Patent Number: 5,720,542

[45] Date of Patent: Feb. 24, 1998

[54] TOOL SYSTEM FOR REACHING A CONFINED LOCATION

[76] Inventors: William F. Birge, Jr., 26951 Via Zaragosa, Mission Viejo, Calif. 92691; Robert Valenzuela, 2724 Genuine Risk St., Perris, Calif. 92571

[21] Appl. No.: 786,694

[22] Filed: Jan. 22, 1997

[51] Int. Cl.[6] ..... B25B 23/18

[52] U.S. Cl. ..... 362/120; 362/109; 81/57.24; 81/57.35

[58] Field of Search ..... 362/109, 119, 362/120, 253; 81/57.12, 57.24, 57.28, 57.35, 574

[56] References Cited

U.S. PATENT DOCUMENTS

| | | | |
|---|---|---|---|
| 933,639 | 9/1909 | Frink . | |
| 1,029,905 | 6/1912 | Andersen | 81/57.24 |
| 1,309,727 | 7/1919 | Greig et al. . | |
| 2,594,908 | 4/1952 | Gaulke et al. | 362/120 X |
| 3,351,111 | 11/1967 | Biddle | 145/52 |
| 3,696,694 | 10/1972 | Boro | 81/57.27 |
| 4,713,007 | 12/1987 | Alban | 434/45 |
| 4,803,904 | 2/1989 | Stanich et al. | 81/54 |
| 4,817,275 | 4/1989 | Van Berkel | 81/57.4 X |
| 4,970,918 | 11/1990 | Brewer et al. | 81/57.29 |
| 5,169,225 | 12/1992 | Palm | 362/118 |
| 5,400,681 | 3/1995 | Strauch | 81/177.2 |

*Primary Examiner*—Stephen F. Husar

*Attorney, Agent, or Firm*—Stetina Brunda Garred & Brucker

[57] ABSTRACT

A hand tool system having a longitudinally extendable operating component and a longitudinally extendable support component for reaching a remote and/or confined location. The operating component includes a worm drive having a proximal end for attachment to a rotational drive device such as a drill motor, and a distal end for attachment to a rotational driver having a first end which can accept a connector engagement device such as a screwdriver head or other type bit and a second end from which extends a pivotable arm. The support component has a pivotable distal end with a securement member releasably securable to a structure, a hand engageable proximal end, and an exterior surface slidingly engageable with the pivotal arm extending from the driver. In use, an operator manipulates the support component with one hand while powering the drill motor with the other hand such that the support component engages the pivotable arm of the driver to thereby leverage and stabilize the driver during rotational movement of the screwdriver or other bit head and consequent placement of a screw member.

18 Claims, 2 Drawing Sheets

56
16
40
44
42

30
26
28
14
18
24
18

TOOL SYSTEM FOR REACHING A CONFINED LOCATION

FIELD OF THE INVENTION

This invention relates in general to a hand tool system, and in particular to hand tools having an operating component through which a worm drive extends for connection to a driver for driving screws and the like into a confined structure such as a ceiling mount for a pocket door, while a support component in pivotal communication with and disposed adjacent the operating component functions to position and stabilize the driver during screw placement in the structure.

BACKGROUND OF THE INVENTION

In performing certain construction and maintenance tasks in both home and commercial settings, it many times is necessary to work at remote or difficult to reach locations for installation of various hardware. One such location that exemplifies a difficult-to-reach site is track hardware within a wall pocket for supporting a sliding door that resides in the pocket. Specifically, and especially when it is necessary to replace this hardware because the door no longer slides thereon, it can be necessary to actually take out a portion of the wall forming the pocket to reach, remove and replace the hardware. Other examples of difficult-to-reach sites include ceiling locations, foundation locations, crawl-space locations, etc. Presently available devices meant to address the problem of reaching a confined site generally only include the provision of an elongated handle member on otherwise non-modified tools. Unfortunately, such an approach may not be sufficient to render these tools functional for remote or confined operation.

In view of the requirement of performing work at confining locations, it is apparent that a need is present for hand tools capable of reaching such locations. Accordingly, a primary object of the present invention is to provide a hand tool system for reaching a confined location wherein the system comprises longitudinally extendable components for site placement.

Another object of the present invention is to provide a hand tool system wherein a first component thereof is an operating component while a second component thereof provides support and stabilization to the operating component.

Yet another object of the present invention is to provide a hand tool system wherein operation capabilities include a worm drive for screw placement at a confined location.

These and other objects of the invention will become apparent throughout the description which now follows.

SUMMARY OF THE INVENTION

The present invention is a hand tool system having a longitudinally extendable operating component and a longitudinally extendable support component for reaching a confined location. A worm drive extends through the operating component, and has a proximal end extending through the open proximal end of the operating component for attachment to a rotational drive device. The distal end of the worm drive extends through the open distal end of the operating component for attachment to a rotational driver. The driver has a first end capable of releasably accepting a connector engagement device such as a screwdriver head or other type bit, and a second end having a pivotable arm extending therefrom. A longitudinally extendable support component, extendable to a length at least substantially equal to the extendable length of the operating component, is positionable generally parallel with the operating component. The support component has a pivotable distal end with a securement member releasably securable to a structure and a hand engageable proximal end. Additionally, the support component has an exterior surface slidingly engageable with the pivotal arm that extends from the driver such that support and stability can be provided from below to the driver as operation thereof screws a connector such as a screw into structure. A light source can be provided to thereby illuminate a work site at the tip of the driver.

In use, an operator connects a rotational drive device such as a powered drill motor to the proximal end of the worm drive extending from the operating component to thereby provide rotation to the rotational driver disposed at the distal end of the worm drive. Assuming a screw is to be driven into a ceiling structure, for example, a preferably magnetized screwdriver bit is provided to the driver. The support component is then positioned such that its ultimate location will be below and generally parallel with the operating component. Both the operating component and the support component are extended as necessary to accommodate the location of the work site, and the support component is secured to structure at its distal pivotable end. Subsequently, and after retaining a screw with the bit, the operating component is positioned above the support component such that the pivotable arm of the driver is slidingly engaged with the surface of the support component and the screw is positioned at its proposed site of entry into the ceiling. Thereafter, the operator activates the drill motor with one hand and manipulates the support component with the other hand to thereby provide stability and leverage to the rotational driver as it turns and screws the screw into the structure. In this manner, remotely and/or confined work areas can be serviced without demolition and rebuilding of adjacent structures.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
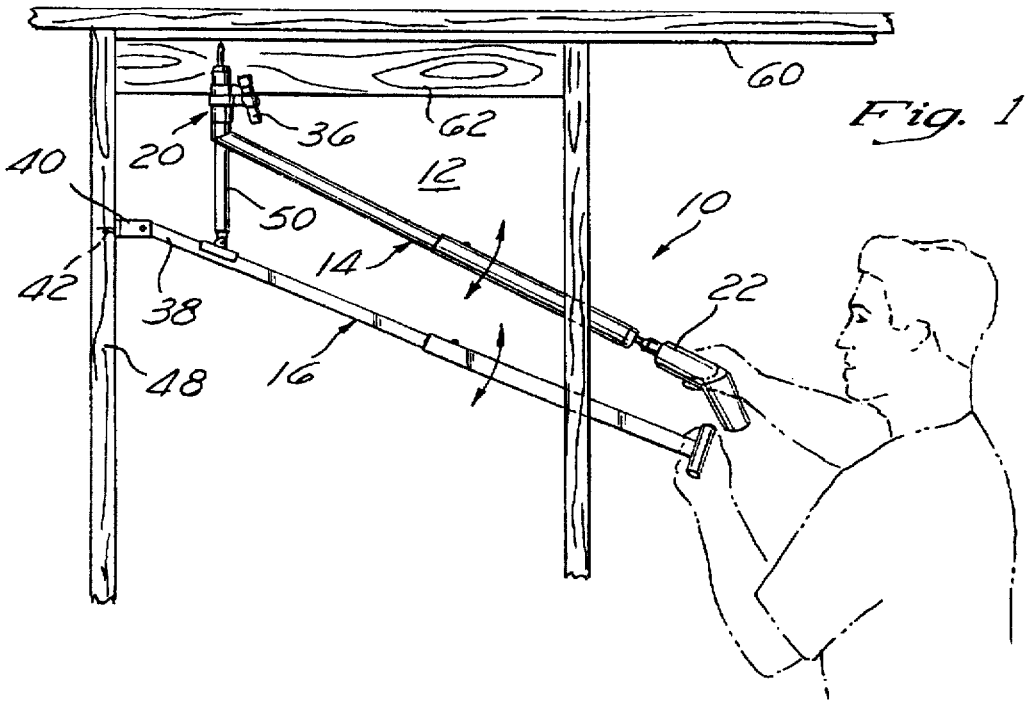
FIG. 1 is a perspective view of a tool system operable in confined and remote space.
Figure 2:
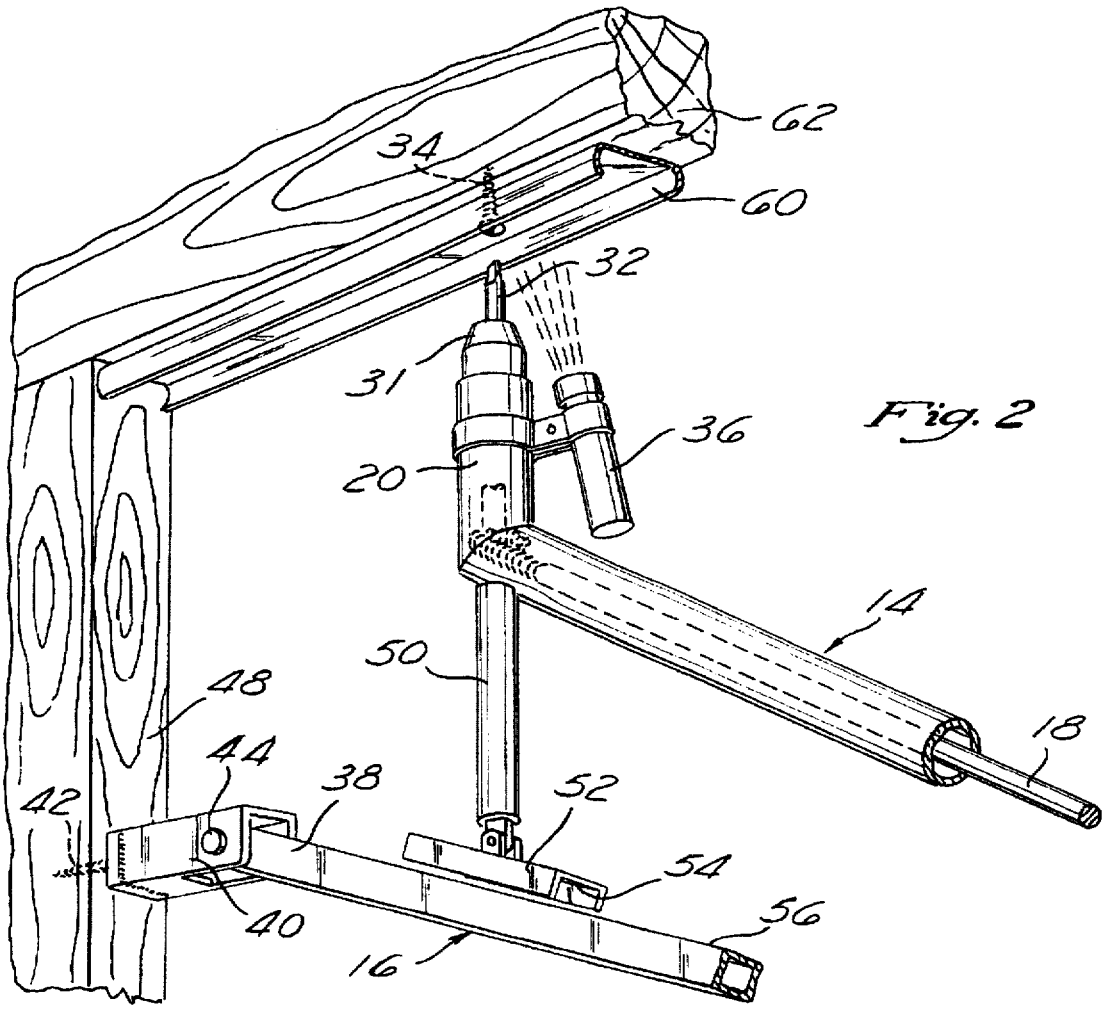
FIG. 2 is an enlarged perspective view of the distal end of the tool system of FIG. 1.
Figure 3:
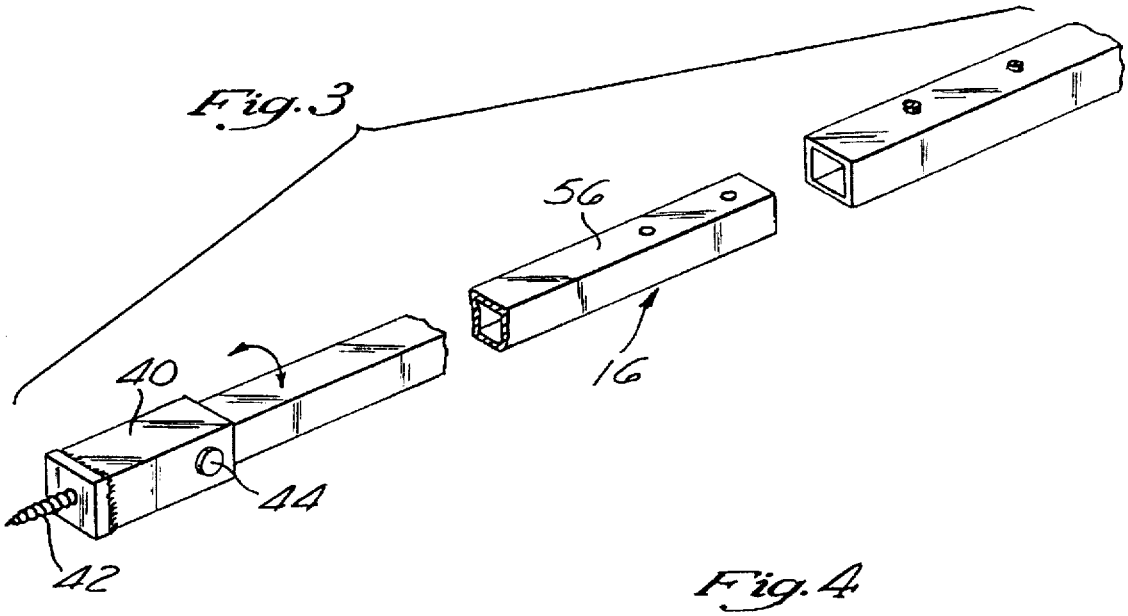
FIG. 3 is an exploded partial view of the support component of FIG. 1.
Figure 4:
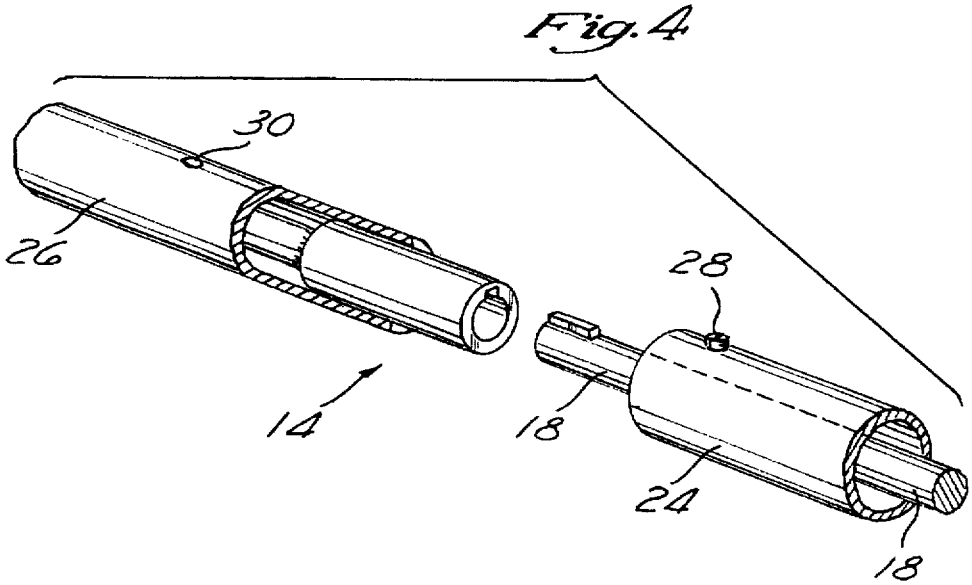
FIG. 4 is an exploded partial view of the operating component of FIG. 1.

Referring to FIG. 1, a hand tool system 10 is illustrated in an operating environment here shown as a pocket door compartment 12 as the door is located between back-to-back wall members (not shown) in a typical construction. The system 10 includes a longitudinally extendable operating component 14 and a generally parallel longitudinally extendable support component 16, with each being substantially equally extendable. As shown in FIGS. 2 and 4, a standard worm drive 18 extends through the operating component 14 to engage a conventional rotatable driver 20 distally while being accessible to a standard drill motor 22 proximally through respective distal and proximal open ends of the operating component 14. As more clearly shown in FIG. 4, the operating component 14 is telescopic, with one piece 24 of lesser diameter placeable within another piece 26 of greater diameter and releasably retained therein by a spring pin 28 passing through an aperture 30 of the piece 26 of greater diameter, as recognized in the art. In like manner, and as shown in FIG. 3, the support component 16 is telescopically extendable.

The driver 20 has at its first end 30 a chock for releasably accepting a connector engagement device such as a screwdriver bit 32 for rotatably engaging a connector such as a screw 34 in direct relationship to rotation operation of the drill motor 22 as transferred through the worm drive 18 as known in the art. A light source here being a small flashlight 36 is mounted on the driver 20 such that a beam of light projects to the work site. The support component 16 has at its distal end 38 a pivotable bracket 40 having a screw tip 42. The bracket 40 is constructed as known in the art such that when the bracket 40 and support component 16 are in alignment, the support component 16 moves on its pivot hinge pin 44 within the bracket 40 such that the support component 16 is locked from pivoting. A screw tip 42 extends from the pivotable bracket 40 for threaded engagement with a structure such as the back wall 48 of a pocket-door compartment 12. By locking the support component 16 and its bracket 40 to prevent pivoting, the screw tip 42 can be engaged with a structure by clockwise rotation (and removed from the structure by counter-clockwise rotation) by hand of the support component 16 as indicated by the arrow shown in FIG. 3. After such attachment to a structure, merely pulling outwardly on the support component 16 will unlock the bracket 40 to thereby reinstate pivotability of the support component 16 on the bracket 40.

Extending from the second end 50 of the driver 20 is a pivotable arm 52 having a channel 54 which is complimentary in shape to the configuration of the surface 56 of the support component 16 to thereby accept the surface 56 for sliding engagement therewith. While a flat surface 56 is here shown, it is, of course, to be understood that other complimentarily-shaped surface-and-arm combinations are feasible. As is evident in FIGS. 1 and 2 of the drawings, the support component 16 is positioned such that the operating component 14 and the support component 16 are generally parallel to each other and sufficiently close to permit placement of the arm 52 on the surface 56 of the support component 16.

Exemplified operation of the tool system 10 is shown in FIGS. 1 and 2. Specifically, and as earlier described, a pocket door (not shown) resides when not in use within a pocket door compartment 12 situated between the back sides of two walls, as earlier related. Such a pocket door is suspended from a track 60 which is secured into the ceiling 62 of the compartment 12. Securement of the track 60 generally is accomplished by a plurality of screws 34 (only one shown) directed into the ceiling 62. To accomplish this track securement into the ceiling, a user first determines, through dimensional study or a series of proposed placements, the most appropriate site for the support component 16 to adequately perform its function. When the site is determined, the support component 16 is screwed into the back wall 48 via the screw tip 42 extending from the pivotal bracket 40 such that the support component 16 can be pivoted upwardly and downwardly by hand. Thereafter, the operating component 14 is made ready for the work site. A drill motor 22 is connected to the worm drive 18, while a magnetized screwdriver bit 32 is attached in the chock of the driver 20. The flashlight 36 is illuminated, the track 60 is held in place by a helper, a screw 34 is magnetically introduced to the bit 32 and positioned at a desired site of the track 60, and the pivotable arm 52 is engaged on the surface 56 of the support component 16 as the user manipulates the support component 16. Power then is provided to the drill motor 22 and operated by one hand of the user as the user continues, with his other hand, support and leverage via the support component 16 to the driver 20 through the pivotable arm 52 and the screw 34 is driven into the ceiling 62. Thereafter, additional screws 34 can be identically introduced along the track 60 by sequentially moving the operating component 14 such that the driver 20 is repositioned while support thereto through the pivotable arm 52 via the support component 16 likewise is continued. After all screws 34 are placed, the operating component 14 is removed from the compartment 12 and the support component 16 is unscrewed from the back wall 48, thereby leaving a newly mounted track 60 on which the pocket door can be mounted.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A hand tool system for reaching a confined location, the system comprising:

a) a longitudinally extendable operating component having an open proximal end and an open distal end;

b) a worm drive extending through the operating component, said drive having a proximal end extending through the open proximal end of the operating component and attachable to a rotational drive device, and a distal end extending through the open distal end of the operating component and attachable to a driver;

c) a driver attachable to the distal end of the worm drive, said driver having a first end capable of releasably accepting a connector engagement device and a second end having a pivotable arm extending therefrom; and d) a longitudinally extendable support component extendable to a length at least substantially equal to the extendable length of the operating component and positionable generally parallel with the operating component, said support component having a pivotable distal end with a securement member releasably securable to a structure and a hand engageable proximal end, with the support component having an exterior surface slidingly engageable with the pivotal arm extending from the driver.

2. A hand tool system as claimed in claim 1 having in addition a light source directable to a work site adjacent the first end of the driver.

3. A hand tool system as claimed in claim 2 wherein the securement member of the pivotable distal end of the support component is a screw tip.

4. A hand tool system as claimed in claim 3 wherein the pivotable arm extending from the second end of the driver terminates as a channel within which the surface of the support component can slidingly reside.

5. A hand tool system as claimed in claim 1 wherein the securement member of the pivotable distal end of the support component is a screw tip.

6. A hand tool system as claimed in claim 1 wherein the pivotable arm extending from the second end of the driver terminates as a channel within which the surface of the support component can slidingly reside.

7. A hand tool for reaching a confined location, the tool comprising:

a) a longitudinally extendable operating component having an open proximal end and an open distal end;

b) a worm drive extending through the operating component, said drive having a proximal end extending through the open proximal end of the operating component and attachable to a rotational drive device, and a distal end extending through the open distal end of the operating component and attached to a driver, said driver having a first end capable of releasably accepting a connector-engagement device and a second end having a pivotable arm extending therefrom; and c) a longitudinally extendable support component extendable to a length at least substantially equal to the extendable length of the operating component and positionable generally parallel with the operating component, said support component having a pivotable distal end with a securement member releasably securable to a structure and a hand engageable proximal end, with the support component having an exterior surface slidingly engageable with the pivotal arm extending from the driver.

8. A hand tool as claimed in claim 7 having in addition a light source directable to a work site adjacent the first end of the driver.

9. A hand tool as claimed in claim 8 wherein the securement member of the pivotable distal end of the support component is a screw tip.

10. A hand tool as claimed in claim 9 wherein the pivotable arm extending from the second end of the driver terminates as a channel within which the surface of the support component can slidingly reside.

11. A hand tool as claimed in claim 7 wherein the securement member of the pivotable distal end of the support component is a screw tip.

12. A hand tool as claimed in claim 7 wherein the pivotable arm extending from the second end of the driver terminates as a channel within which the surface of the support component can slidingly reside.

13. A hand tool for reaching a confined location, the tool comprising:

a) a longitudinally extendable operating component having an open proximal end and an open distal end;

b) a worm drive extending through the operating component, said drive having a proximal end extending through the open proximal end of the operating component and attachable to a rotational drive device, and a distal end extending through the open distal end of the operating component and attached to a driver, said driver having a first end with a connector-engagement device releasably housed therein and extending therefrom, and a second end having a pivotable arm extending therefrom;

c) a light source attached to the driver, said light source having a light beam aimed toward a site distal of the connector-engagement device; and d) a longitudinally extendable support component extendable to a length at least substantially equal to the extendable length of the operating component and positionable generally parallel with the operating component, said support component having a pivotable distal end with a securement member releasably securable to a structure and a hand engageable proximal end, with the support component having an exterior surface slidingly engageable with the pivotal arm extending from the driver.

14. A hand tool as claimed in claim 13 wherein the connector-engagement device is a screwdriver head.

15. A hand tool as claimed in claim 14 wherein the securement member of the pivotable distal end of the support component is a screw tip.

16. A hand tool as claimed in claim 15 wherein the pivotable arm extending from the second end of the driver terminates as a channel within which the surface of the support component can slidingly reside.

17. A hand tool as claimed in claim 13 wherein the securement member of the pivotable distal end of the support component is a screw tip.

18. A hand tool as claimed in claim 13 wherein the pivotable arm extending from the second end of the driver terminates as a channel within which the surface of the support component can slidingly reside.

* * * * *